US012478188B2

(12) United States Patent
Li

(10) Patent No.: US 12,478,188 B2
(45) Date of Patent: Nov. 25, 2025

(54) DETACHABLE INFLATABLE SOFA WITH PLURALITY OF AIR CAVITIES

(71) Applicant: Shanghai Sunshine Development Co., Ltd., Shanghai (CN)

(72) Inventor: Cheng Li, Shanghai (CN)

(73) Assignee: Shanghai Sunshine Development Co., Ltd., Shanghai (CN)

( * ) Notice: Subject to any disclaimer, the term of this patent is extended or adjusted under 35 U.S.C. 154(b) by 210 days.

(21) Appl. No.: 18/312,141

(22) Filed: May 4, 2023

(65) Prior Publication Data

US 2024/0099469 A1 Mar. 28, 2024

(30) Foreign Application Priority Data

Sep. 28, 2022 (CN) ..... 202211190802.4

(51) Int. Cl.
*A47C 17/86* (2006.01)

(52) U.S. Cl.
CPC ..... *A47C 17/86* (2013.01)

(58) Field of Classification Search
None
See application file for complete search history.

(56) References Cited

U.S. PATENT DOCUMENTS 3,973,800 A * 8/1976 Kogan ..... A47C 7/002 297/135
5,689,845 A * 11/1997 Sobieralski ..... A61G 5/1091 297/452.41
6,321,404 B1 * 11/2001 Tsai ..... A47C 27/081 5/710
7,434,282 B2 * 10/2008 Fraser ..... B29C 66/53461 5/655.3
2010/0205749 A1 * 8/2010 Huang ..... A47C 27/081 5/710
2016/0007765 A1 * 1/2016 Sheldrake ..... A47C 31/113 150/158
2017/0035636 A1 * 2/2017 Stiff ..... A61G 7/05776
2019/0104829 A1 * 4/2019 Clary ..... A45F 4/02
2020/0260880 A1 * 8/2020 Nelson ..... A47C 19/027
2022/0265061 A1 * 8/2022 Barrett, III ..... A47C 27/148
(Continued)

FOREIGN PATENT DOCUMENTS

CA 2309367 A1 * 11/2001 ..... A47C 27/081
CN 204273908 U * 4/2015
CN 205251004 U 5/2016
(Continued)

OTHER PUBLICATIONS

Foreign.*

*Primary Examiner* — Tara Schimpf

(57) ABSTRACT

Disclosed is a detachable inflatable sofa with a plurality of air cavities, including a sofa cover and a plurality of inflatable air cavities, wherein each adjacent two of the air cavities are detachably connected, and all the air cavities are connected to form a body of the sofa; and the sofa cover is sleeved on an outer surface of the body. The air cavities are detachably connected and are then fixed and shaped through the sofa cover, so that the detachable inflatable sofa is convenient to disassemble and assemble, transport and early. Moreover, if a certain air cavity is damaged, it can be replaced independently, so that the usage cost is saved.

9 Claims, 7 Drawing Sheets

(56) References Cited

U.S. PATENT DOCUMENTS

2022/0408929 A1* 12/2022 Gansow ..... A47C 4/028

FOREIGN PATENT DOCUMENTS

| | | | | | |
|---|---|---|---|---|---|
| CN | 105686466 | A | * | 6/2016 | |
| CN | 105686465 | A | * | 6/2019 | |
| CN | 211300806 | U | * | 8/2020 | |
| CN | 211391615 | U | | 9/2020 | |
| CN | 211512386 | U | * | 9/2020 | |
| CN | 211533524 | U | | 9/2020 | |
| JP | 2015123227 | A | * | 7/2015 | ..... A47B 13/088 |
| TW | 202211839 | A | * | 4/2022 | |

* cited by examiner

DETACHABLE INFLATABLE SOFA WITH PLURALITY OF AIR CAVITIES

CROSS-REFERENCE TO RELATED APPLICATIONS

The application claims priority to Chinese patent application No. 202211190802.4, filed on Sep. 28, 2022, the entire contents of Which are incorporated herein by reference.

TECHNICAL FIELD

The present invention belongs to the technical field of sofa, and particularly relates to a detachable inflatable sofa with a plurality of air cavities.

BACKGROUND

Inflatable sofas usually take a universal inflatable product PVC as a raw material. By pressurizing, air enters into the sofas. The inflatable sofas further overcome the defect of heaviness of conventional furniture, and feature either fashion or comfort. Nowadays, colorful, crystal clear bizarrely shaped and uniquely modeled inflatable sofas are popular with the new trend one.

There are a great variety of inflatable sofas on the market presently. However, most inflatable sofas are of integrated structures. The inflatable sofas are large in size even if air is exhausted, so that it is troublesome to store the inflatable sofas and inconvenient to carry and MOW. For example, it is difficult to take the inflatable sofas outdoors during outdoor activities.

SUMMARY

The present invention is mainly intended to provide a detachable inflatable, sofa with a plurality of air cavities. The air cavities are detachably connected and are then fixed and shaped through the sofa cover, so that the detachable inflatable sofa is convenient to disassemble and assemble, transport and carry. Moreover, if a certain air cavity is damaged, it can be replaced independently, so that the usage cost is saved.

TO solve the above technical problems, a technical solution adopted by the present invention is as follows: the present invention provides a detachable inflatable sofa with a plurality of air cavities, including a sofa cover and a plurality of inflatable air cavities, wherein each adjacent two of the air cavities are detachably connected, and all the air cavities are connected to form a body of the sofa; and the sofa cover is sleeved on an outer surface of the body.

Further, the adjacent air cavities are not communicated, each adjacent two of the air cavities is independently provided with an inflating connector, the corresponding air cavity is inflated through the inflating connector corresponding thereto, and the sofa cover is sleeved on outer surfaces of the air cavities to realize shaping and detachable connection of all the air cavities.

Further, the inflatable sofa further includes an air pump, the air cavities are communicated through an air passage joint and are detachably connected, and the air pump is communicated with one of the air cavities.

Further, any two connected air cavities are defined as a first air cavity and a second air cavity; the air passage joint includes a first connecting tube, a second connecting tube and a connecting sleeve; one end of the first connecting tube is fixed to the first cavity, one end of the second connecting tube is fixed to the first air cavity, and the first connecting tube and the second connecting tube are in abutting joint and are relatively fixed through the connecting sleeve.

Further, the first connecting tube is provided with an external thread, the connecting sleeve is provided with an internal thread, an end part of the second connecting tube is provided with a flange extending radially and outwardly, an end of the connecting sleeve is provided with a step extending radially and inwardly, the connecting sleeve is sleeved on a peripheral surface of the second connecting tube, and the connecting sleeve rotates to drive the first connecting tube and the second connecting tube to be in abutting joint and to relatively lock and fix the first connecting tube and the second connecting tube.

Further, the first connecting tube is a rigid tube, and the second connecting tube is a rigid tube or a flexible tube.

Further, a root of the second connecting tube is high frequency welded to the second air cavity; and a root of the second connecting tube is high frequency welded to the second air cavity.

Further, the air pump is internally arranged in one of the air cavities;

or one of the air cavities is provided with an inflating connector, and the air pump is arranged externally and is capable of being communicated with the one of the air cavities through the inflating connector.

Further, the air pump is an inflator pump or an air pump for inflation and exhaustion.

Further, four air cavities are arranged and are a base air cavity, a backrest air cavity, a left armrest air cavity and a right armrest air cavity in sequence; the backrest air cavity is communicated with the base air cavity, the left armrest air cavity and the right armrest air cavity simultaneously; and the air pump is internally arranged in the backrest air cavity.

Further, a surface of at least one air cavity is provided with a heating pad, and the heating pad is connected to a control panel.

Further, the sofa cover is of an integrated structure.

Further, the sofa cover is provided with an opening for facilitating taking the air cavities out.

Further, the opening is connected to the sofa cover through a zipper or a magic tape.

The present invention has the following beneficial effects:

the detachable inflatable sofa provided by the present invention includes the sofa cover and the plurality of inflatable air cavities, each adjacent two of the air cavities are detachably connected, and all the air cavities are connected to form the body of the sofa; the sofa cover is sleeved the outer surface of the body, and the sofa cover, on the one hand, plays a role of fixing and shaping the air cavities, so that the assembled sofa does not deform; on the other hand, the inflatable sofa can be detached, i.e., the air cavities can be taken out from the sofa cover, and the air cavities can be detached for facilitating transportation, carrying and assembly; moreover, in the using process, if a certain air cavity is damaged, it can be replaced independently. Compared with an integrated structure with one air cavity, which can only be integrally scrapped after damage, the usage cost is greatly lowered;

furthermore, the surface of at least one air cavity of the present invention is provided with the heating pad, the heating pad is connected to the control panel, and by arranging the heating pad, the using comfort level of the sofa can be improved and the effect is more obvious in an environment with low temperature;

moreover, the sofa cover of the present invention is of the integrated structure, and the air cavities are put in the sofa cover one by one through the formed opening for facilitating assembling and detaching the sofa cover; and compared with a multi-sheet sofa cover, the assembling process of the product is further convenient.

The above description is merely an overview of the technical solution of the present invention. In order to better understand the technical means of the present invention and achieve implementation according to content of the specification, detailed description below is provided in combination with preferred embodiments and drawings of the present invention.

Figure 1:
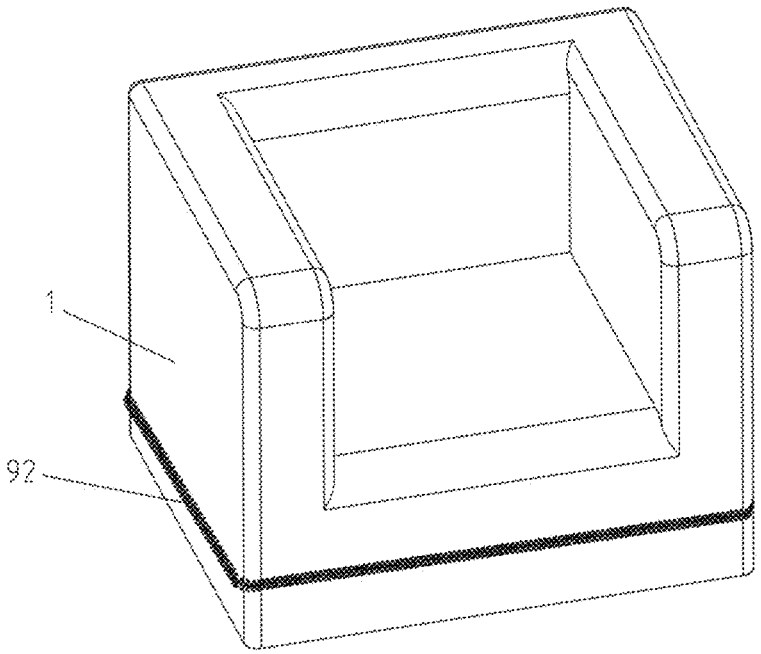
FIG. 1 is an external view of the embodiment 1 of the present invention.
Figure 2:
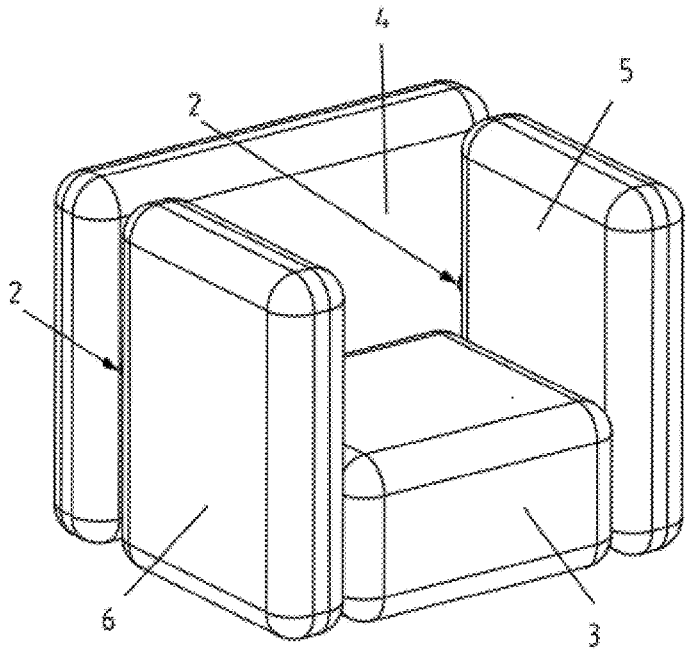
FIG. 2 is a structural schematic diagram of the embodiment 1 of the present invention (a sofa cover is not shown).
Figure 3:
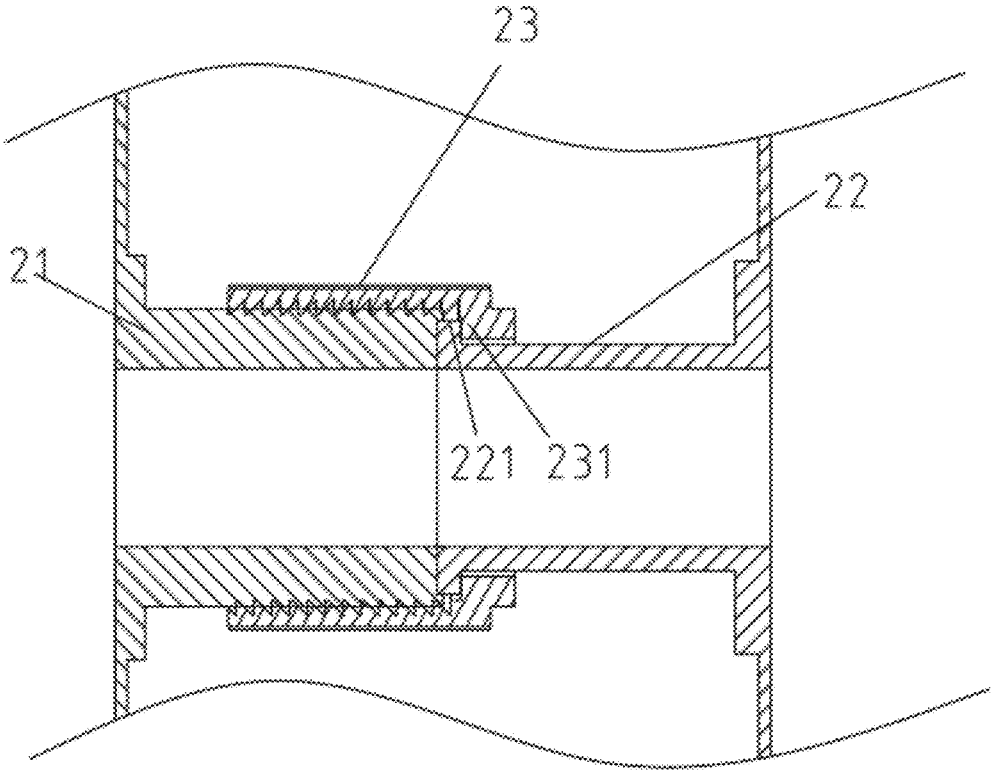
FIG. 3 is an axial section view of an air passage joint of the present invention.
Figure 4:
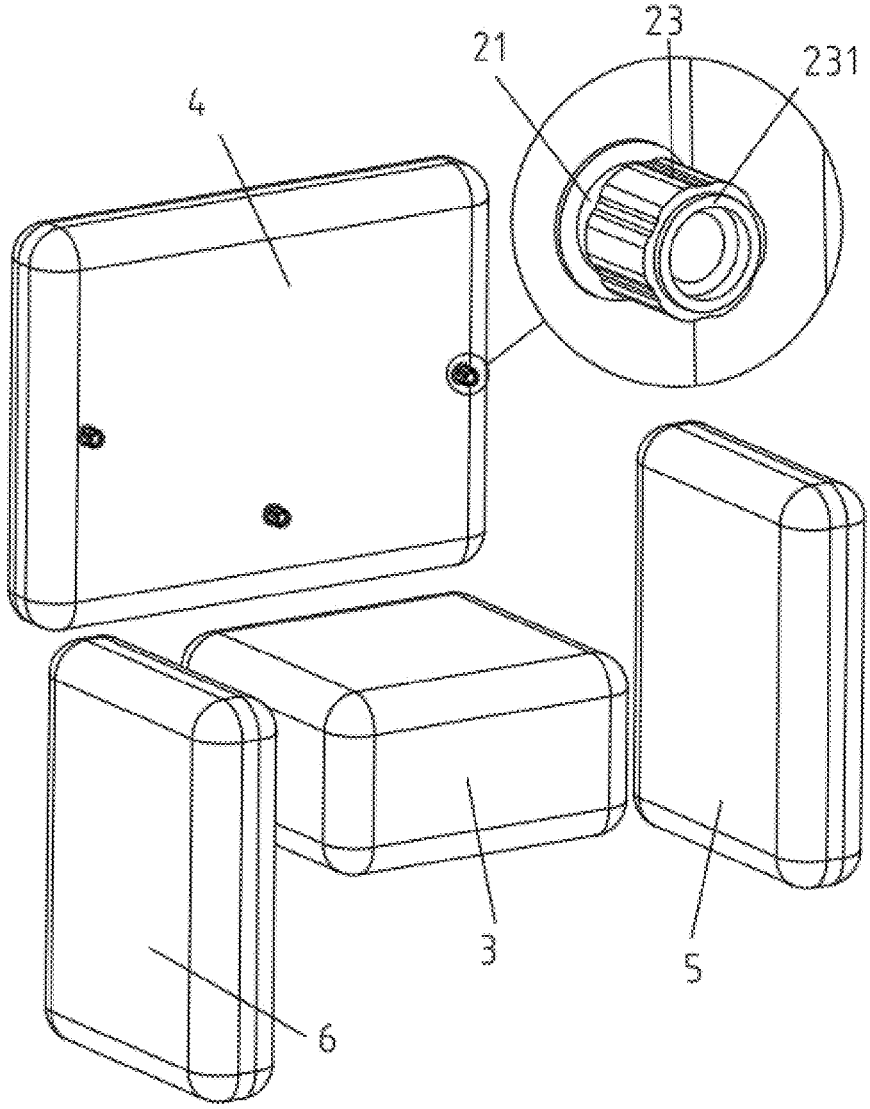
FIG. 4 is a breakdown structural schematic diagram I of each air cavity of the present invention (front view).
Figure 5:
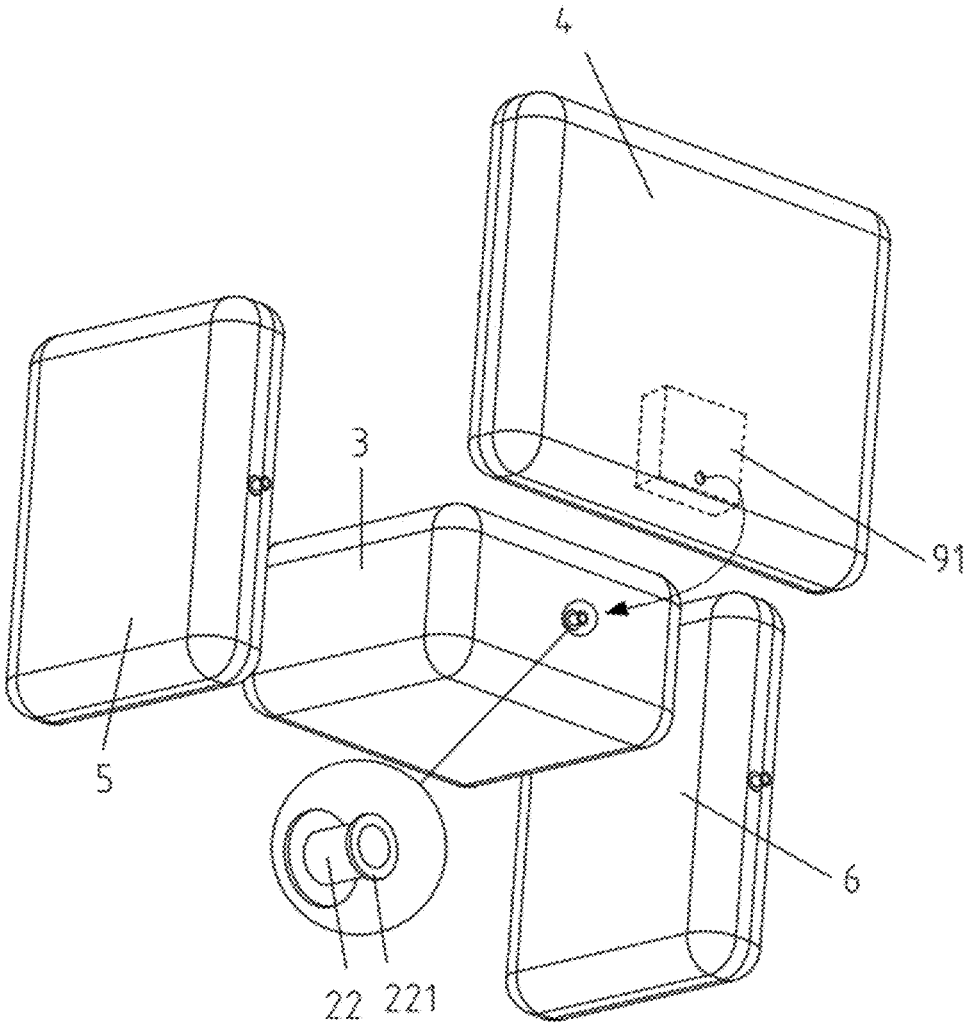
FIG. 5 is a breakdown structural schematic diagram II of each air cavity of the present invention (rear view).

NUMERALS IN THE DRAWINGS sofa cover 1;

air passage joint 2, first connecting tube 21, second connecting tube 22, flange 221, connecting sleeve 23, step 231;

base air cavity 3;

backrest air cavity 4;

left armrest air cavity 5;

right armrest an cavity 6;

heating pad 7;

control panel 8;

air pump 91;

zipper 92;

magic tape 93.

DETAILED DESCRIPTION OF THE EMBODIMENTS

Implementation modes of the present invention are described below through specific embodiments. Those skilled in the art can easily understand advantages and functions of the present invention from the content disclosed by the description. The present invention can further be implemented in other different modes, i.e., the present invention can be modified and changed differently without departing the scope disclosed b the present invention.

Embodiment 1: a detachable inflatable sofa with a plurality of air cavities, as shown in FIG. 1-5, includes a sofa cover 1 and a plurality of inflatable air cavities, wherein each adjacent two of the air cavities are detachably connected, and all the air cavities are connected to form a body of die sofa; and the sofa cover is sleeved on an outer surface of the body.

The sofa cover, on the one hand, plays a role of fixing and shaping the air cavities, so that the assembled sofa does not deform. On the other hand, the inflatable sofa can be detached, i.e., the air cavities can be taken out from the sofa cover, and the air cavities can be detached tor facilitating transportation and subsequent assembly; moreover, in the using process, if a certain air cavity is damaged, it can be replaced independently. Compared with an integrated structure with one air cavity, which can only be integrally scrapped after damage, the usage cost is greatly lowered.

When the inflatable sofa is not used or it is necessary to take the inflatable sofa outdoors for use, the air cavities can be taken out, and air is exhausted, so that the space is greatly saved, and it is convenient to store or carry.

In the embodiment, the inflatable sofa further includes an air pump 91, the air cavities are communicated through an air passage joint 2 and are detachably connected, and the air pump 91 is communicated with one of the air cavities.

In the embodiment, any two connected air cavities are defined as a first air cavity and a second air cavity: the air passage joint includes a first connecting tube 21, a second connecting tube 22 and a connecting sleeve 23; one end of the first connecting tube is fixed to the first cavity, one end of the second connecting tube is fixed to the first air cavity, and the first connecting tube and the second connecting tube are in abutting joint and are relatively fixed through the connecting sleeve.

In the embodiment, the first connecting tube is provided with an external thread, the connecting sleeve is provided with an internal thread, an end part of the second connecting rube is provided with a flange 221 extending radially and outwardly, an end of the connecting sleeve is provided with a step 231 extending radially and inwardly, the connecting sleeve is sleeved on a peripheral surface of the second connecting tube, and the connecting sleeve rotates to drive the first connecting tube and the second connecting tube to be in abutting joint and to relatively lock and fix the first connecting tube and the second connecting tube.

Actually, there are many structures where the two connecting tubes are connected together through the connecting sleeve and are then detached, which are not described repeatedly one by one.

The first connecting tube is a rigid tube, and the second connecting tube is a rigid, tube or a flexible tube.

In the embodiment, more preferably, the first connecting tube is the rigid tube for the convenience of machining a thread; and the second connecting tube is the flexible tube, and when the first connecting tube and the second connecting tube are in abutting joint, the flexible tube can play a role of increasing seal.

Either the first connecting tube or the second connecting tube can be the rigid tube. To guarantee the sealing property, a sealing structure such as a seal ring can be additionally arranged.

Of course, besides the specific structure of the air passage joint, there may be various structures of the air passage joint. For example, the structure only includes the first connecting tube and the second connecting tube, and the first connecting tube and the second connecting tube can be spliced together forcibly.

In the embodiment, a root of the second connecting tube is high frequency welded to the second air cavity; and a root of the second connecting tube is high frequency welded to the second air cavity. Not limited to this, other fixing modes can be adopted as long as the first connecting tube and the first air cavity and the second connecting tube and the second air cavity can be fixed.

In the embodiment, four air cavities are arranged and are a base air cavity 3, a backrest air cavity 4, a left armrest air cavity 5 and a right armrest air cavity 6 in sequence; the backrest air cavity is communicated with the base air cavity, the left armrest air cavity and the right armrest air cavity simultaneously, and the base air cavity, the left armrest air cavity and the right armrest air cavity are not communicated one another; and the air pump 91 is internally arranged in the backrest air cavity.

The left armrest air cavity 5 and the right armrest air cavity 6 in the embodiment are distinguished after people sit on the sofa.

Of course, one air cavity neither refers to any one of the four air cavities. For example, the base air cavity and the left armrest air cavity can be made as a whole which is called one air cavity. Then the backrest air cavity and the right armrest air cavity can be made as a whole which is also called one air cavity. The following connecting modes are then adopted in front of the two air cavities. This structural form also falls into the scope of protection of the technique.

The air pump 91 can be designed either internally or externally. Specifically, the air pump 91 is internally arranged in one of the air cavities; internally arranging the air pump 91 in a certain closed cavity belongs to the prior art, and the principle thereof is similar to that of an inflatable mattress with an internal pump. Therefore, the specific structures where the air pump 91 and the air cavities are arranged internally are not described repeatedly one by one.

Or one of the air cavities is provided with an inflating connector (the position of the sofa cover corresponding to the position can be provided with an opening for facilitating inflation), and the air pump 91 is arranged externally and is capable of being communicated with the one of the air cavities through the inflating connector.

The air pump 91 is an inflator pump or an air pump for inflation and exhaustion (an air pump with inflating and exhausting functions at the same time), and the inflator pump and the air pump for inflation and exhaustion both belong to the prior art, which are not described repeatedly.

In the embodiment, more preferably, the sofa cover is of an integrated structure.

The sofa cover is provided with an opening ter the convenience of taking the air cavities out. Size, shape and position of the opening can be designed according to the size of the air cavities and the degree of convenience to take the air cavities.

The opening is connected to the sofa cover through a zipper 92 or a magic tape 93. Not limited to this, the opening can be opened and then closed.

Of course, the sofa cover can further be of a split structure splice (by a plurality of sheets), with slightly poor using effect.

Figure 6:
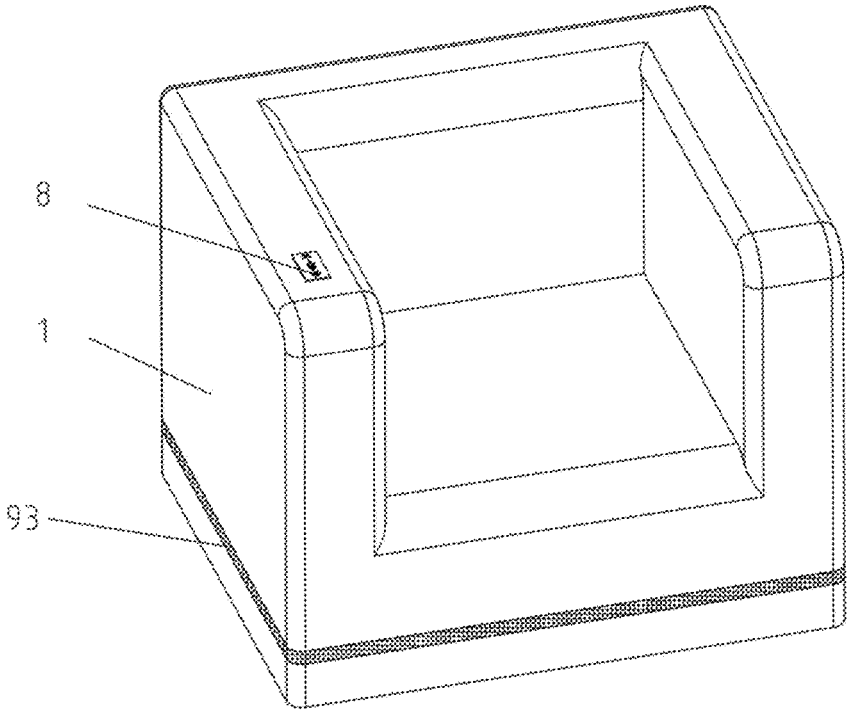
FIG. 6 is an external view of the embodiment 2 of the present invention.
Figure 7:
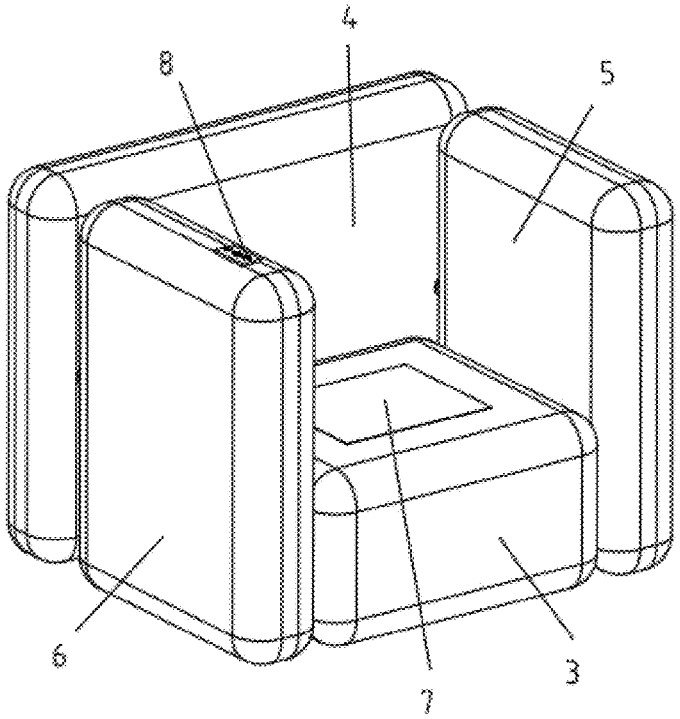
FIG. 7 is a structural schematic diagram of the embodiment 2 of the present invention (a sofa cover is not shown).

Embodiment 2: the structure of a detachable inflatable sofa with a plurality of air cavities is similar to that in the embodiment 1. The difference lies in that as shown in FIG. 6 and FIG. 7, a surface of at least one air cavities is provided with a heating pad 7, and the heating pad is connected to a control panel 8.

After being assembled, the heating pad is located between the surface of the air cavity and the sofa cover.

Of course, for facilitating operation of the control panel, the control panel is inevitably exposed out of the sofa cover.

More preferably, the control panel is located on the upper surface of the left armrest air cavity or the right armrest air cavity for the convenience of operation, More preferably, the heating pad is located on the surface of the backrest air cavity and/or the base air cavity to play an extremely heating role, so as to improve the comfort level.

More preferably, the air pump 91 is internally arranged in the backrest air cavity, so that it can be directly communicated with the residual three air cavities simultaneously with high inflating efficiency and relatively ideal inflating effect; and moreover, compared with a condition that the air pump 91 is located in the base air cavity, the air pump 91 needs not to undertake most weight of a human body, so that the air pump 91 is prevented from unnecessary damage and the like. If the air pump 91 is arranged in the left armrest air cavity or the right armrest air cavity, although the air pump 91 neither undertakes most weight of the human body, the purpose of being directly connected to the residual three air cavities cannot be achieved.

Embodiment 3: the structure of a detachable inflatable sofa with a plurality of air cavities is similar to that in the embodiment 1. The difference lies in that each adjacent two of the air cavities are not communicated, each of the air cavities is independently provided with an inflating connector corresponding thereto (not shown in the drawings), the corresponding air cavity is inflated through the inflating connector, and the sofa cover is sleeved on outer surfaces of the air cavities to realize shaping and detachable connection of all the air cavities.

That is to say, the plurality of air cavities in the embodiment are independent one another and are not communicated by an air passage. Each of the air cavities is independently inflated through the internally or externally arranged air pump, and all the air cavities are fixed and shaped through the sofa cover.

However, the embodiment 1 is superior to the embodiment, in the embodiment 1, all the air cavities can be inflated through one internally arranged air pump, so that it is convenient and cost-saving; and in the embodiment, the plurality of air cavities can be inflated through a plurality of internally arranged air pumps, so that the weight of the product increases and the cost of the product is improved.

Embodiment 4: the structure of a detachable inflatable sofa with a plurality of air cavities is similar to that in the embodiment 3. The difference lies in that a surface of at least one air cavity is provided with a heating pad, and the heating pad is connected to a control panel.

After being assembled, the heating pad is located between the surface of the air cavity and the sofa cover.

Of course, for facilitating operation of the control panel, the control panel is inevitably exposed out of the soft cover.

The above is merely embodiments of the present invention, and does not hence limit the patent range of the present invention. Equivalent structures made by means of the contents of the description and drawings of the present invention are applied to other related technical fields directly or indirectly, which is, in a similar way, comprised in the protection scope of the patent of the present invention.

What is claimed is:

1. An inflatable sofa with a plurality of cavities, comprising a sofa cover (1) and a plurality of inflatable cavities, wherein each adjacent cavities are detachably connected to each other, and all the cavities are connected to each other to form a body of the sofa; and the sofa cover is sleeved on an outer surface of the body;

wherein the inflatable sofa further comprises an air pump, the cavities are communicated with each other through an air passage joint (2) and are detachably connected to each other, and the air pump is connected with one of the cavities;

wherein any two cavities connected to each other are defined as a first cavity and a second cavity; the air passage joint comprises a first connecting tube (21), a second connecting tube (22) and a connecting sleeve (23); one end of the first connecting tube is fixed to the first cavity; one end of the second connecting tube is fixed to the second cavity, and the first connecting tube and the second connecting tube are in abutting joint and are relatively fixed through the connecting sleeve;

wherein the first connecting tube is provided with an external thread, the connecting sleeve is provided with an internal thread, an end part of the second connecting tube is provided with a flange (221) extending radially and outwardly, an end of the connecting sleeve is provided with a step (231) extending radially and inwardly, the connecting sleeve is sleeved on a peripheral surface of the second connecting tube, and the connecting sleeve rotates to drive the first connecting tube and the second connecting tube to be in abutting joint and to relatively lock and fix the first connecting tube and the second connecting tube to each other, wherein the step (231) and the flange (221) forming a complimentary shaped connection.

2. The inflatable sofa with a plurality of cavities according to claim 1, wherein the first connecting tube is a rigid tube, and the second connecting tube is a rigid tube or a flexible tube.

3. The inflatable sofa with a plurality of cavities according to claim 1, wherein a root of the first connecting tube is high frequency welded to the first cavity; and a root of the second connecting tube is high frequency welded to the second cavity.

4. The inflatable sofa with a plurality of cavities according to claim 1, wherein the air pump is internally arranged in one of the cavities; or one of the cavities is provided with an inflating connector, and the air pump is arranged externally and is capable of being connected with one of the cavities through the inflating connector.

5. The inflatable sofa with a plurality of cavities according to claim 4, wherein the air pump is an inflator pump or an air pump for inflation and exhaustion.

6. The inflatable sofa with a plurality of cavities according to claim 5, wherein the plurality of cavities comprises four cavities and are a base cavity (3), a backrest cavity (4), a left armrest cavity (5) and a right armrest cavity (6), respectively; the backrest cavity is connected with the base cavity, the left armrest cavity and the right armrest cavity simultaneously; and the air pump is internally arranged in the backrest cavity.

7. The inflatable sofa with a plurality of cavities according to claim 1, wherein a surface of at least one cavity is provided with a heating pad (7), and the heating pad is connected to a control panel (8).

8. The inflatable sofa with a plurality of cavities according to claim 1, wherein the sofa cover is provided with an opening for facilitating taking the cavities out.

9. The inflatable sofa with a plurality of cavities according to claim 8, wherein the opening is connected to the sofa cover through a zipper or a magic tape.

* * * * *